US010598123B2

(12) United States Patent
Kobayashi

(10) Patent No.: US 10,598,123 B2
(45) Date of Patent: Mar. 24, 2020

(54) LADDER FRAME FOR INTERNAL COMBUSTION ENGINE

(71) Applicant: TOYOTA JIDOSHA KABUSHIKI KAISHA, Toyota-shi (JP)

(72) Inventor: Kojiro Kobayashi, Nagakute (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 0 days.

(21) Appl. No.: 16/184,014

(22) Filed: Nov. 8, 2018

(65) Prior Publication Data

US 2019/0186413 A1 Jun. 20, 2019

(30) Foreign Application Priority Data

Dec. 14, 2017 (JP) ..... 2017-239668

(51) Int. Cl.
*F02F 7/00* (2006.01)

(52) U.S. Cl.
CPC ..... *F02F 7/0021* (2013.01); *F02F 7/0053* (2013.01); *F02F 2007/0056* (2013.01)

(58) Field of Classification Search
CPC ..... F02F 7/0021; F02F 7/0053; F02F 7/0085; F02F 2007/0056
See application file for complete search history.

(56) References Cited

U.S. PATENT DOCUMENTS 6,684,845 B2 * 2/2004 Cho ..... F01M 11/0004 123/195 H
8,413,633 B2 * 4/2013 Dunlavey ..... F02F 7/0053 123/195 H (Continued)

FOREIGN PATENT DOCUMENTS

EP 1 482 157 A1 12/2004
JP 8-284749 10/1996

(Continued)

OTHER PUBLICATIONS

Machine translation for JP H11-044252A, Sekine et al., Manufacture of Lower Case for Internal Combustion Engine and Device Therefore, obtained from https://worldwide.espacenet.com/, published Feb. 16, 1999, pp. 1-15. (Year: 1999).*

*Primary Examiner* — Grant Moubry
(74) *Attorney, Agent, or Firm* — Oblon, McClelland, Maier & Neustadt, L.L.P.

(57) ABSTRACT

A ladder frame for an internal combustion engine includes a first lateral wall and a second lateral wall, crank caps, and first joining portions and second joining portions. Each crank cap includes an arc-shaped center portion, a first lateral portion and a second lateral portion. Each first lateral portion is joined to the first lateral wall via each first joining portion, and each second lateral portion is joined to the second lateral wall via each second joining portion. Each center portion includes a supporting portion that rotatably supports the crankshaft, the center portion including a recess to which the residual portion is joined, on the opposite side to the supporting portion. Respective thicknesses of the first lateral portion and the second lateral portion are the same as that of the center portion. The recess is provided with a projection embedded in the residual portion.

3 Claims, 5 Drawing Sheets

(56) References Cited

U.S. PATENT DOCUMENTS

| | | | | |
|---|---|---|---|---|
| 8,690,440 | B2 * | 4/2014 | Mochida | F16C 9/02 384/432 |
| 8,770,170 | B2 * | 7/2014 | Mulay | F02F 7/0053 123/195 R |
| 9,011,012 | B2 * | 4/2015 | Hoshikawa | F16C 9/02 384/432 |
| 2006/0016061 | A1 * | 1/2006 | Shelef | F02B 77/00 29/464 |

FOREIGN PATENT DOCUMENTS

| | | | |
|---|---|---|---|
| JP | 08284748 | A * | 10/1996 |
| JP | 11-44252 | | 2/1999 |
| JP | 2004-353511 | | 12/2004 |

* cited by examiner

LADDER FRAME FOR INTERNAL COMBUSTION ENGINE

INCORPORATION BY REFERENCE

The disclosure of Japanese Patent Application No. 2017-239668 filed on Dec. 14, 2017 including the specification, drawings and abstract is incorporated herein by reference in its entirety.

BACKGROUND

1. Technical Field

The present disclosure relates to a ladder frame for an internal combustion engine.

2. Description of Related Art

There is known a ladder frame for an internal combustion engine that supports a crankshaft between the ladder frame and a cylinder block. A ladder frame is formed, generally, such that crank caps are molded together with a pair of lateral walls for supporting the crank caps from both sides by casting a molten aluminum alloy as a molten metal. Here, each crank cap is formed with a supporting portion that rotatably supports the crankshaft, and also is formed with a recess on the opposite side to the supporting portion (See Japanese Patent Application Publication No. 11-044252, for example). In the finished ladder frame, the both lateral portions of each crank cap are joined to the respective lateral walls by the aluminum alloy, and the aluminum alloy is formed so as to continuously and partially cover each crank cap from the both lateral portions to the recess of the crank cap.

SUMMARY

As for the thickness of the crank cap of the finished ladder frame, the thickness including the aluminum alloy partially covering each crank cap is required to satisfy predetermined designing conditions. For this reason, considering the thickness of the aluminum alloy, the thicknesses of the both lateral portions of each crank cap, which are covered by the aluminum alloy, are previously formed to be thinner than the thicknesses of the portions that are not covered by the aluminum alloy. In order to secure the rigidity of the crank caps under the above designing conditions, it can be considered to remove the aluminum alloy from the both lateral portions that are covered by the aluminum alloy, and then increase the thicknesses of the both lateral portions by this removed thicknesses. In this case, in each crank cap, the aluminum alloy that joins the both lateral portions to the pair of lateral walls is separated from the aluminum alloy covering the recess, so that the aluminum alloy is left in the recess as a residual portion. If the internal combustion engine is used in such a state, the residual portion might come off from the recess.

To cope with this, an aspect of the present disclosure suppresses a residual portion from coming off from each crank cap, while securing the thickness of the crank cap under designing conditions.

One aspect of the present disclosure is a ladder frame for an internal combustion engine that supports a crankshaft between the ladder frame and a cylinder block. The ladder frame includes: a first lateral wall and a second lateral wall; metallic crank caps; and first joining portions and second joining portions joining the crank caps respectively to the first lateral wall and the second lateral wall. The first lateral wall and the second lateral wall are made of a metallic material having a lower rigidity than a rigidity of the crank caps. Each of the crank caps includes an arc-shaped center portion, a first lateral portion and a second lateral portion that are located at positions where the center portion is interposed between the first lateral portion and the second lateral portion. Each first lateral portion is joined to the first lateral wall via each first joining portion, and each second lateral portion is joined to the second lateral wall via each second joining portion. Each center portion includes a supporting portion that rotatably supports the crankshaft, each center portion having a recess on an opposite side to the supporting portion. A residual portion is joined to each recess in such a manner as to be discontinuous from the first joining portion and the second joining portion. The residual portion is made of the same material as a material of the first joining portion and the second joining portion. Respective thicknesses of each first lateral portion and each second lateral portion are the same as a thickness of the center portion. Each recess is provided with a projection embedded in the residual portion so as to suppress the residual portion from coming off from the recess.

With the above configuration, it is possible to provide a ladder frame for an internal combustion engine that suppresses a residual portion from coming off from each crank cap, while securing the thickness of each crank cap under designing conditions.

In the ladder frame for the internal combustion engine, each projection may include a base and a tip end. At least a part of the base in the thickness direction of each crank cap may have a thinner thickness than a thickness of the tip end in the thickness direction.

In the ladder frame for the internal combustion engine, a width of the base in the width direction of each crank cap may be wider than a width of the tip end in the width direction.

In the ladder frame for the internal combustion engine, each projection may be provided at a position set back from a predetermined line segment. The predetermined line segment may be a line segment that passes through a center of a rotation axis of the crankshaft and is parallel to a reciprocating direction of a piston in synchronization with the crankshaft.

BRIEF DESCRIPTION OF THE DRAWINGS

Features, advantages, and technical and industrial significance of exemplary embodiments of the disclosure will be described below with reference to the accompanying drawings, in which like numerals denote like elements, and wherein.

DETAILED DESCRIPTION OF EMBODIMENTS

Figure 1A:
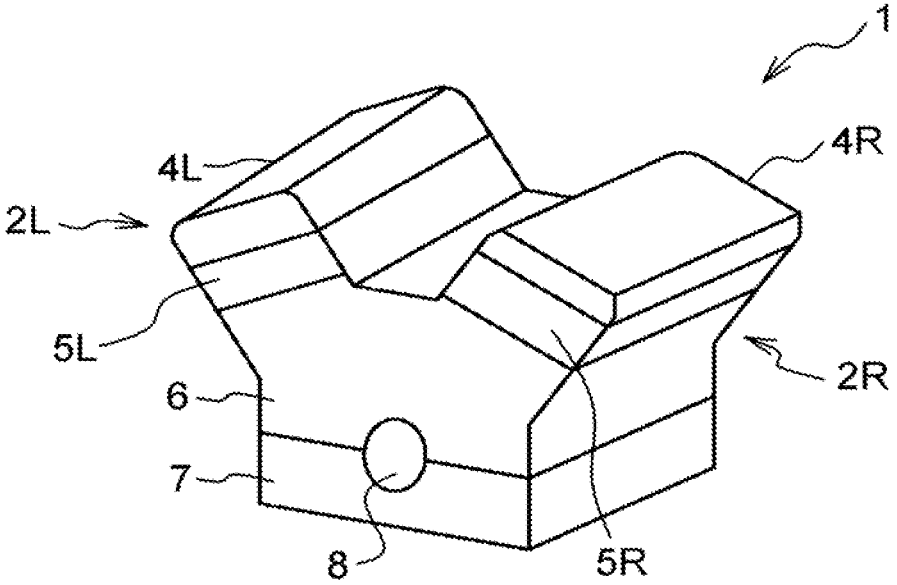
FIG. 1A is a schematic view of an internal combustion engine.

FIG. 1A is a schematic view of an engine 1. The engine 1 is a V-6 cylinder engine having a pair of banks 2L, 2R projecting in a V-shape on a cylinder block 6, and is one example of an internal combustion engine. The banks 2L, 2R respectively include cylinder heads 5L, 5R disposed to the top end part of the cylinder block 6, and head covers 4L, 4R mounted to the respective top ends of the cylinder heads 5L, 5R. In the cylinder block 6, three cylinders are provided to each of the banks 2L, 2R, and a piston is provided inside each cylinder. Each piston is coupled to the crankshaft 8 so as to transmit motive power. Furthermore, a ladder frame 7 is mounted to the bottom part of the cylinder block 6. The crankshaft 8 is rotatably supported by the cylinder block 6 and the ladder frame 7.

Figure 1B:
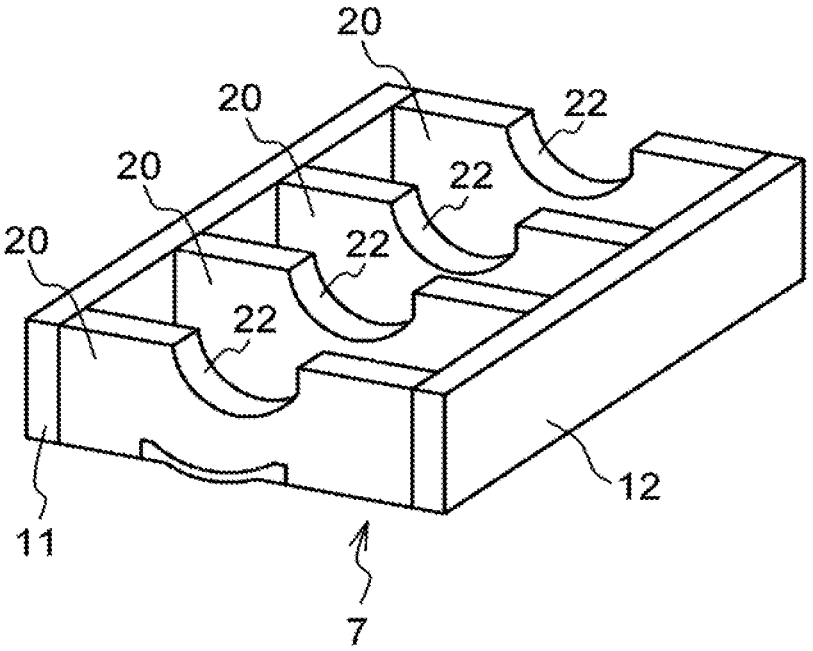
FIG. 1B is a schematic view of a ladder frame.

FIG. 1B is a schematic view of the ladder frame 7. The ladder frame 7 includes lateral walls 11 and 12 that face each other and are arranged in generally parallel to each other, and four crank caps 20 held between lateral walls 11, 12 and joined to these lateral walls in such a manner that the crank caps 20 are arranged one by one along the axial direction of the crankshaft 8. Each of the crank caps 20 is formed with a supporting portion 22 having a semi-circular-shaped upper portion, and the respective supporting portions 22 rotatably support a journal part of the crankshaft 8 from below. The lateral walls 11, 12 are made of an aluminum alloy, and the crank caps 20 are made of iron. These multiple crank caps 20 are molded together with the lateral walls 11, 12 previously formed by casting a molten aluminum alloy as a molten metal. Thus, the crank caps 20 are joined to the lateral walls 11, 12, and thereafter, the aluminum alloy adhering to the crank caps 20 is partially removed so as to be formed into the ladder frame 7.

Figure 2A:
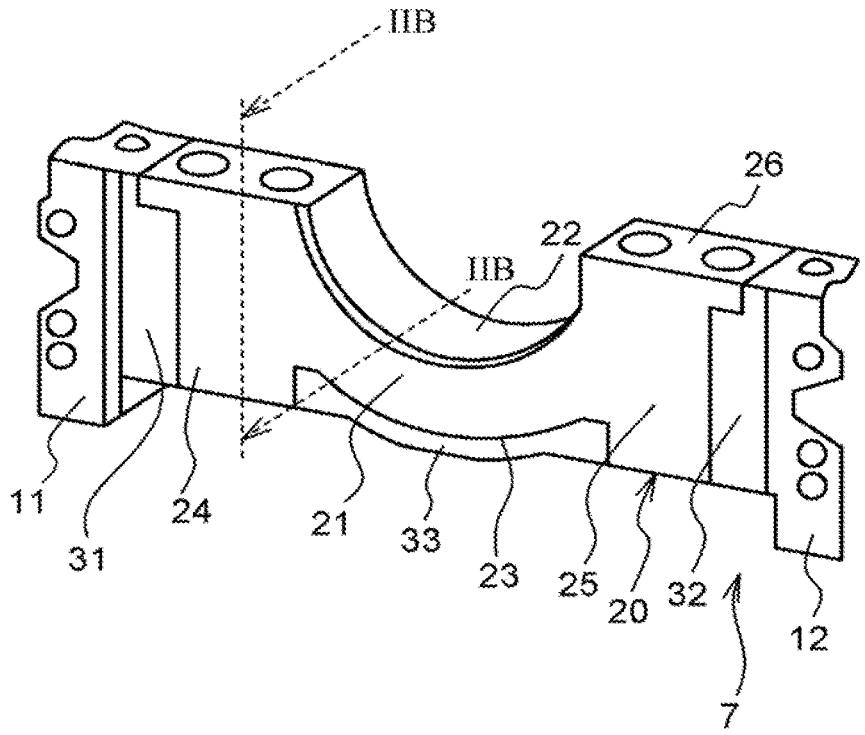
FIG. 2A is an enlarged perspective view of a crank cap.
Figure 2B:
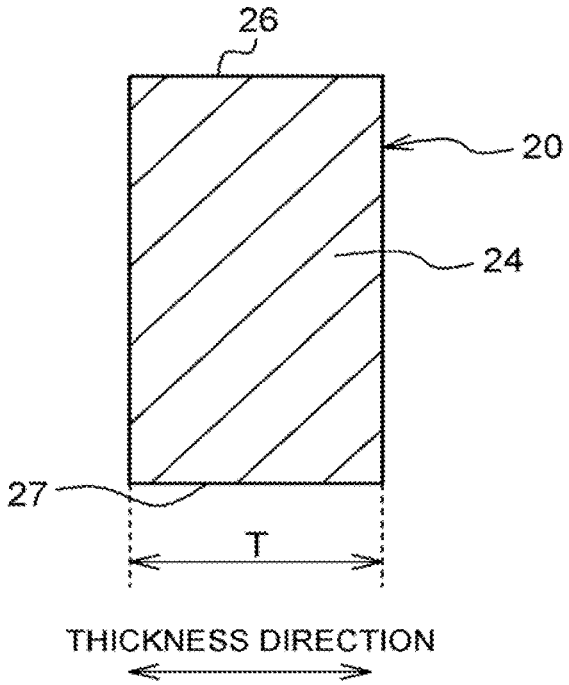
FIG. 2B is a sectional view taken along line IIB-IIB of FIG. 2A.

FIG. 2A is an enlarged perspective view of the crank cap 20. FIG. 2B is a sectional view taken along line IIB-IIB of FIG. 2A. As shown in FIG. 2A, each crank cap 20 includes a center portion 21 in an arc-shape, and lateral portions 24, 25 located at positions where the center portion 21 is interposed therebetween. The lateral portions 24, 25 are joined respectively to the lateral walls 11, 12 via joining portions 31, 32. The center portion 21 includes the supporting portion 22 formed on an upper surface 26 side and a recess 23 formed on a lower surface 27 side opposite to the supporting portion 22. The lateral portions 24, 25 are continued to the upper surface 26 and the lower surface 27. Hence, each crank cap 20 after being finished as the ladder frame 7 exhibits an M shape. FIG. 2B shows a section of the lateral portion 24, and a thickness T in the lateral portion 24 is also the same in the center portion 21 and the lateral portion 25.

The joining portions 31, 32 and a residual portion 33 are portions formed by the aluminum alloy that is hardened from a molten state after the crank caps 20 are molded together with the lateral walls 11, 12. Accordingly, the joining portions 31, 32 and the residual portion 33 are made of the same aluminum alloy. The aluminum alloy is one example of a metallic material having a lower rigidity than that of the crank caps 20. The joining portions 31, 32 and the residual portion 33 are discontinuous from each other. Note that the upper surface 26 and the lower surface 27 are provided with multiple through-holes for bolts used for fixing the crank caps 20 to the cylinder block 6. The upper surface 26 is fixed to the cylinder block 6, as aforementioned, and the lower surface 27 is fixed to a not-illustrated oil pan.

Figure 3A:
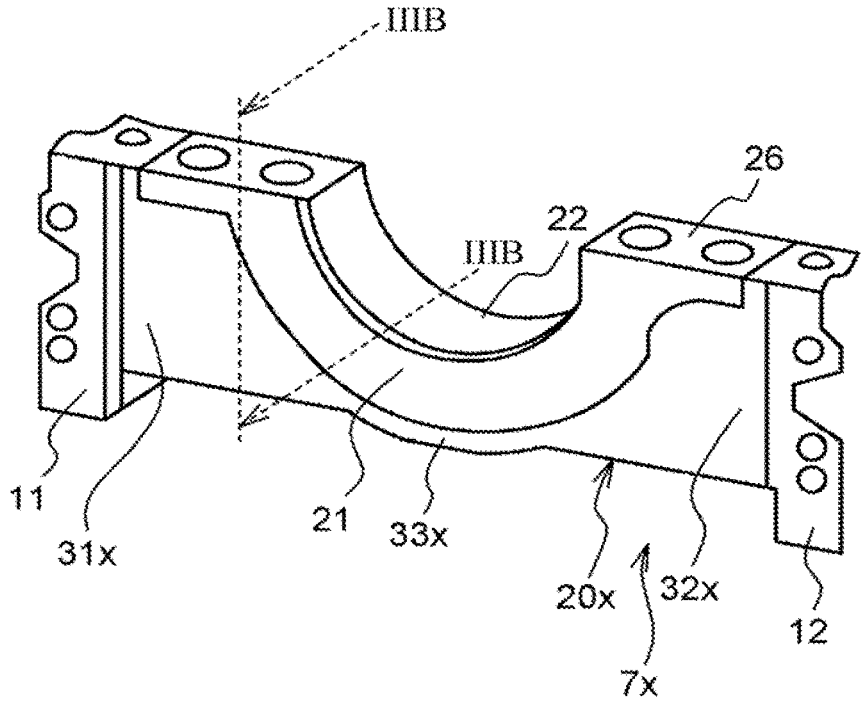
FIG. 3A is an enlarged perspective view of a crank cap of a ladder frame of a comparative example.
Figure 3B:
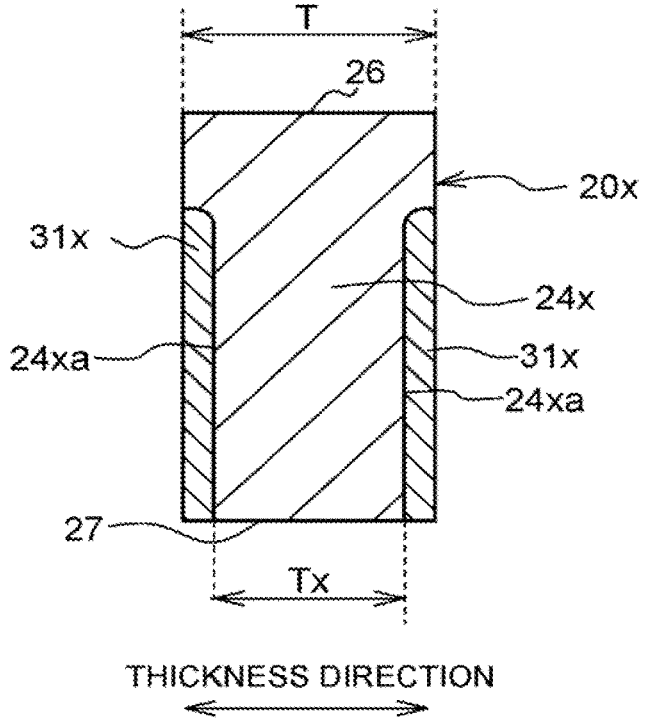
FIG. 3B is a sectional view taken along line IIIB-IIIB of FIG. 3A.

FIG. 3A is an enlarged perspective view of each crank cap 20*x* of a ladder frame 7*x* of a comparative example. FIG. 3B is a sectional view taken along line IIIB-IIIB of FIG. 3A. In the comparative example, similar configurations to those of the present embodiment will be denoted by similar reference numerals, and duplicated description thereof will be omitted. Joining portions 31*x*, 32*x* in each crank cap 20*x* extend to regions corresponding to the lateral portions 24, 25 in the present embodiment, and the joining portions 31*x*, 32*x* are continued to a continued portion 33*x* located opposite to the supporting portion 22. That is, the joining portions 31*x*, 32*x* and the continued portion 33*x* continuously cover a major part of the crank cap 20*x*. As with the joining portion 31 and the like, the joining portions 31*x*, 32*x* and the continued portion 33*x* are portions formed by the aluminum alloy that is hardened from a molten state.

Here, the thickness of the crank cap 20*x* is the same in a portion covered by the joining portion 31*x* and in the center portion 21 and the like that is not covered by the joining portion 31*x*. FIG. 3B shows the thickness of each crank cap 20*x* in the vicinity of the joining portion 31*x*. A recess 24*xa* is formed in one surface of a lateral portion 24*x* that is a portion of the crank cap 20*x* covered by the joining portion 31*x*; and similarly, a recess 24*xa* that is covered by the joining portion 31*x* is also formed in the other surface of the lateral portion 24*x*. That is, the recesses 24*xa* are so formed as to cancel the thickness of the joining portion 31*x*. Accordingly, the thickness T in the portion where the surfaces of the crank cap 20*x* are exposed is thicker than a thickness in the portion of the crank cap 20*x* where the recesses 24*xa* are formed; however, the thickness in the portion of the crank cap 20*x* where the recesses 24*xa* including the joining portions 31*x* are formed is the same as the above-described thickness T.

In this manner, in both the crank cap 20*x* of the comparative example and the crank cap 20 of the present embodiment, the respective maximum thicknesses are set to be the same thickness T. The reason why the thickness is thus set is that predetermined designing conditions are required for the thickness of the crank cap 20 and the thickness of the crank cap 20*x* in order to suppress increase in weight and size.

Comparing the crank cap 20 with the crank cap 20*x*, in the crank cap 20, the regions covered by the joining portions 31, 32 are smaller, and the thicknesses of the lateral portions 24, 25 are the same as the thickness of the center portion 21. Hence, the crank cap 20 has larger regions where the thickness T is secured. To the contrary, in the crank cap 20*x*, the regions covered by the joining portions 31*x*, 32*x* are larger, and thus the crank cap 20 has smaller regions where the thickness T is secured. Here, the joining portions 31*x*, 32*x* covering the larger regions of the crank cap 20*x* are made of the aluminum alloy, and the rigidity thereof is lower than the rigidities of the crank caps 20 and 20*x* that are made of iron. Accordingly, the rigidity is secured more in the crank cap 20 of the present embodiment than in the crank cap 20*x* of the comparative example because the crank cap 20 has larger regions having the thickness T than the regions having the thickness T in the crank cap 20*x*; therefore, the crank cap 20 is applicable to a high-output internal combustion engine. That is, under the above-described designing conditions, the thickness of the crank cap 20 is secured.

Figure 4A:
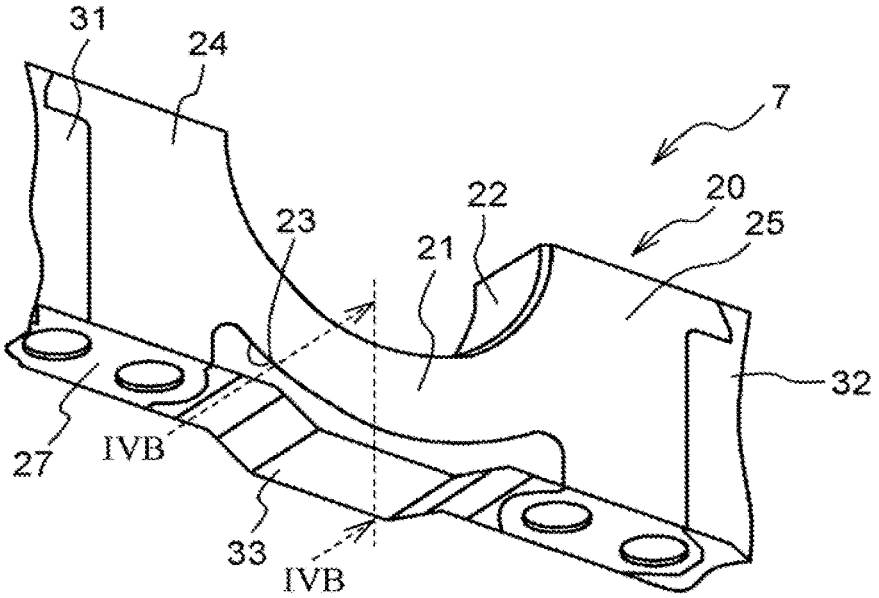
FIG. 4A is a perspective view of a crank cap in the present embodiment, as viewed from a lower position.

Here, in the comparative example, since the joining portions 31*x*, 32*x* are continued to the continued portion 33*x*, these portions are prevented from coming off from the crank cap 20*x*. However, in the crank cap 20 of the present embodiment, the lateral portions 24, 25 has the same thickness as the thickness of the center portion 21, and thus the residual portion 33 is discontinuous from the joining portions 31, 32. FIG. 4A is a perspective view of each crank cap 20 of the present embodiment, as viewed from a lower position. While the engine 1 is in use, there is a risk that the residual portion 33 comes off the recess 23. Hence, each crank cap 20 has a structure to suppress the residual portion 33 from coming off from the recess 23.

Figure 4B:
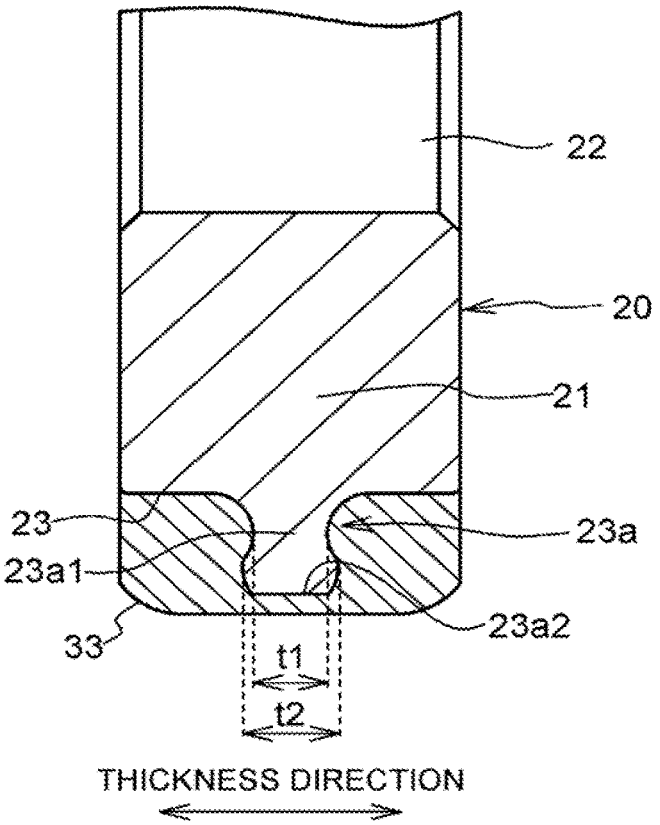
FIG. 4B is a sectional view taken along line IVB-IVB of FIG. 4A.

FIG. 4B is a sectional view taken along line IVB-IVB of FIG. 4A. As shown in FIG. 4B, the recess 23 is formed with a projection 23*a* that projects downward and is embedded in the residual portion 33. The projection 23*a* includes a base 23*a*1 and a tip end 23*a*2. In the thickness direction of the crank cap 20, a minimum thickness t1 in the base 23*a*1 is set to be thinner than a maximum thickness t2 in the tip end 23*a*2. Since the residual portion 33 is a portion formed by the aluminum alloy that is hardened from a molten state after the casting, as aforementioned, the residual portion 33 is formed around the base 23*a*1 and the tip end 23*a*2 with no gaps therebetween. Hence, even when a force for downward movement is applied to the residual portion 33, a part of the residual portion 33, located around the portion where the thickness of the base 23*a*1 becomes minimum, interferes with the portion where the thickness in the tip end 23*a*2 becomes maximum, which is located immediately below this part of the residual portion 33, to thereby hinder the downward movement of the residual portion 33. In this manner, the residual portion 33 is suppressed from coming off from the recess 23.

In order to prevent the residual portion 33 from coming off from the recess 23, as above described, it can be considered to carry out machining to remove the residual portion 33 from the recess 23. However, in this case, it might be supposed that manufacturing man-hours of the ladder frame 7 become increased, and thus the manufacturing cost becomes increased. Furthermore, it can be considered to provide no recess 23 to the crank cap 20. In this case, however, it might be supposed that the bottom surface opposite to the supporting portion 22 in an arc-shape becomes completely flattened; thus, it becomes difficult to properly distribute a load received from the crankshaft 8 in the circumferential direction. Consequently, the load is concentrated onto one part of the crank cap 20, so that it might be impossible to secure load resistance performance. Accordingly, by providing the recess 23 with the projection 23*a* to suppress the residual portion 33 from coming off, it is possible to distribute the load applied to the crank cap 20 so as to secure the load resistance performance, while suppressing increase in manufacturing cost.

Figure 5A:
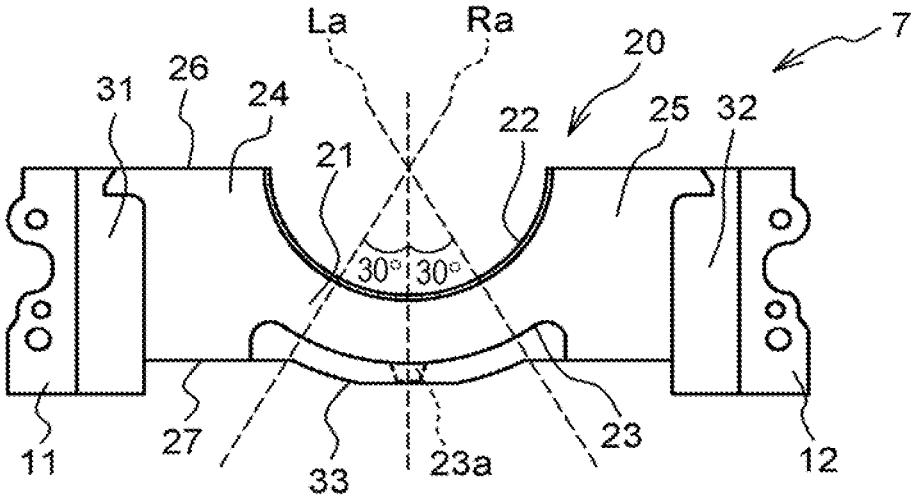
FIG. 5A is a front view of the crank cap.

Next, the position of the projection 23*a* will be described. FIG. 5A is a front view of the crank cap 20. FIG. 5A shows line segments La and Ra indicating reciprocating directions of respective pistons in the banks 2L, 2R. In FIG. 5A, the projection 23*a* embedded in the residual portion 33 is indicated by dotted lines. An angle between the line segments La and Ra is 60°, for example. The projection 23*a* is located at a position between the line segments La and Ra, that is, at a position set back from the line segments La and Ra so as not to intersect them. Here, when the respective pistons perform reciprocating motions, the center portion 21 receives great loads in the directions of the line segments La and Ra from the crankshaft 8. Therefore, the projection 23*a* is provided at a position set back from the portion where such great loads are received. Accordingly, influence to the load resistance performance of the crank cap 20 caused by providing the projection 23*a* is reduced.

Figure 5B:
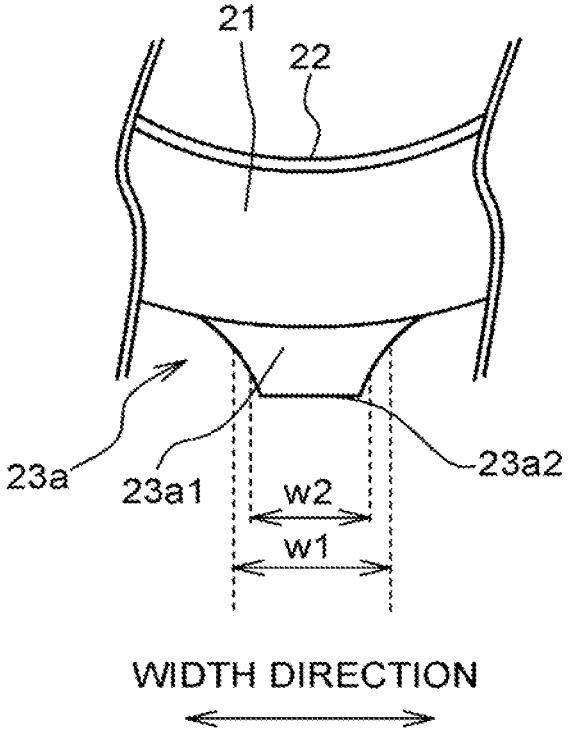
FIG. 5B is a partially enlarged view of a projection of the crank cap before casting, as viewed from the front side.

FIG. 5B is a partially enlarged view of the projection 23*a* of the crank cap 20 before the casting, as viewed from the front side. The shape of the projection 23*a* as viewed from the front side is a tapered shape having a width gradually smaller from the base 23*a*1 toward the tip end 23*a*2. Specifically, a width w1 at the position of the base 23*a*1 in the width direction of the crank cap 20, corresponding to the position of the above-described minimum thickness t1 is wider than a width w2 at the position of the tip end 23*a*2 corresponding to the position of the maximum thickness t2. Specifically, the shape of the projection 23*a* as viewed from the front side is a shape that cannot suppress coming-off of the residual portion 33, different from the shape of the projection 23*a* as viewed from the lateral side shown in FIG. 4B.

Accordingly, for the purpose of further reducing the risk of coming-off of the residual portion 33, it can be considered that the shape of the projection 23*a* as viewed from the front side is formed such that the minimum width of the base 23*a*1 is set to be smaller than the maximum width of the tip end 23*a*2 of the shape of the projection 23*a*, as with the case of FIG. 4B if viewed from the lateral side. As described above, the center portion 21 in an arc-shape as viewed from the front side serves for distributing the load from the crankshaft 8 via the supporting portion 22 in the circumference direction, and the shape of the recess 23 also plays the same role as that of the center portion 21. If such a shape that the width of the projection 23*a* formed in the recess 23 is greatly changed is employed, this shape has a risk to cause influence to the above load distribution in the circumferential direction. Accordingly, it is preferable to employ such a shape as in the present embodiment that the thickness of the projection 23*a* is changed, to thus suppress influence to the distribution of the load from the crankshaft 8 in the circumferential direction, while suppressing coming-off of the residual portion 33.

As aforementioned, the embodiment of the present disclosure has been described in detail; however, the present disclosure is not limited to the above particular embodiment, and various changes and alterations can be made without departing from the scope of the disclosure as defined by the appended claims.

In the above embodiment, a V-6 cylinder engine has been exemplified, but the present disclosure is not limited to a 6-cylinder engine, or is not limited to a V engine, but may be applied to an inline engine. Also in the case of an inline engine, the projection for suppressing the coming-off is preferably disposed apart from a position set back from the line segment that pass through the center of the rotation axis of the crankshaft and are parallel to the reciprocating directions of the respective pistons in synchronization with the motion of the crankshaft. As shown in FIG. 4B, the base 23*a*1 and the tip end 23*a*2 are formed in shapes that are smoothly curved and continued to each other; however, the present disclosure is not limited to this, and they may be formed in linear shapes, for example.

What is claimed is:

1. A ladder frame for an internal combustion engine that supports a crankshaft between the ladder frame and a cylinder block, the ladder frame comprising:

a first lateral wall and a second lateral wall;

metallic crank caps; and first joining portions and second joining portions joining the crank caps respectively to the first lateral wall and the second lateral wall, wherein the first lateral wall and the second lateral wall are made of a metallic material having a lower rigidity than a rigidity of the crank caps, each of the crank caps includes an arc-shaped center portion, a first lateral portion and a second lateral portion that are located at positions where the center portion is interposed between the first lateral portion and the second lateral portion, each first lateral portion is joined to the first lateral wall via each first joining portion, and each second lateral portion is joined to the second lateral wall via each second joining portion, each center portion includes a supporting portion that rotatably supports the crankshaft, each center portion having a recess on an opposite side to the supporting portion, a residual portion is joined to each recess in such a manner as to be discontinuous from the first joining portion and the second joining portion, the residual portion being made of the same material as a material of the first joining portion and the second joining portion, respective thicknesses of each first lateral portion and each second lateral portion are the same as a thickness of the center portion, each recess is provided with a projection embedded in the residual portion so as to suppress the residual portion from coming off from the recess, each projection is provided at a position set back from a predetermined line segment, and the predetermined line segment is a line segment that passes through a center of a rotation axis of the crankshaft and is parallel to a reciprocating direction of a piston in synchronization with the crankshaft.

2. The frame ladder for the internal combustion engine according to claim 1, wherein each projection includes a base and a tip end, and at least a part of the base in a thickness direction of each crank cap has a thinner thickness than a thickness of the tip end in the thickness direction.

3. The frame ladder for the internal combustion engine according to claim 2, wherein a width of the base in a width direction of each crank cap is wider than a width of the tip end in the width direction.

* * * * *